United States Patent [19]

Wier

[11] Patent Number: 4,624,035

[45] Date of Patent: Nov. 25, 1986

[54] PROCESS FOR THE PRODUCTION OF A BELT LOCK FOR A SAFETY BELT

[75] Inventor: Franz Wier, Goggingen, Fed. Rep. of Germany

[73] Assignee: TRW Repa GmbH, Alfdorf, Fed. Rep. of Germany

[21] Appl. No.: 644,046

[22] Filed: Aug. 24, 1984

[30] Foreign Application Priority Data

Aug. 31, 1983 [DE] Fed. Rep. of Germany ..... 3331435

[51] Int. Cl.[4] ..... A44B 11/26

[52] U.S. Cl. ..... 24/642; 24/633

[58] Field of Search ..... 24/633, 639, 642, 274 R

[56] References Cited

U.S. PATENT DOCUMENTS

| | | | |
|---|---|---|---|
| 3,914,832 | 10/1975 | Petrus | 24/274 R |
| 4,197,619 | 4/1980 | Burleigh | 24/642 |
| 4,228,567 | 10/1980 | Ikesue et al. | 24/642 |
| 4,392,282 | 7/1983 | Wier | 24/642 |

FOREIGN PATENT DOCUMENTS

| | | | |
|---|---|---|---|
| 3004150 | 8/1981 | Fed. Rep. of Germany | 24/642 |
| 3027009 | 2/1982 | Fed. Rep. of Germany | 24/642 |
| 2377780 | 8/1978 | France | 24/642 |
| 2083542 | 3/1982 | United Kingdom | 24/642 |

*Primary Examiner*—Peter A. Aschenbrenner
*Attorney, Agent, or Firm*—Young & Tarolli

[57] ABSTRACT

A method of making a safety belt buckle having a rigid base plate defining a belt tongue insertion path, belt tongue locking means having first component fixed to the base plate and a second component movable relative to the first component to lock an inserted belt tongue in the buckle, and an actuator element disposed on the base plate and movable relative to the base plate to cause the second component to release the tongue. The method comprises the steps of forming the first component and the actuator element as a one-piece unit which the first component and the actuator element are interconnected by the frangible connections, mounting the one-piece unit on the base plate, and thereafter moving the actuator element relative to the base plate and first component to cause the frangible connections to break.

7 Claims, 8 Drawing Figures

PROCESS FOR THE PRODUCTION OF A BELT LOCK FOR A SAFETY BELT

The invention relates to a process for the production of a buckle for a safety belt, as well as a belt buckle produced by this process.

Known belt buckles of this kind usually have a base part formed as a U-shaped platen. The base part defines the path for the insertion tongue of the belt band. Joined rigidly with this platen, by means of rivets, for example, are other lock parts. These parts may include a guide part for a metal bar, movable transverse to the insertion path for the insertion tongue, a fastening element for the back pressure spring for a pressure key movable on the platen, which cooperates with the bar, another fastening part for a spring assigned to the bar, which presses the bar into the locking position, and other parts. All these parts are assembled in an expensive mounting process. The process may require expensive mounting and adjusting devices. It is also expensive to produce all these parts in a separate preliminary production, to store them and to prepare them at the mounting place.

The invention attacks the problem of designing a process for the production of a belt lock for a safety belt, as well as the belt lock itself, so that the expense for the production of the belt lock especially the expense for prefabrication, keeping in storage and mounting is very greatly reduced.

Unlike the known production methods for such belt locks, with the present invention, the functional parts to be connected with the platen are joined together at desired break points, so that they form a one-piece mounting component. This mounting component can be produced very rationally in a single injection molding process. The one-piece mounting component forms a unit which is connected with the platen in a single injection molding process. The one-piece mounting component forms a unit which is connected with the platen in a single mounting step. These functional parts are separated after the attaching of this mounting component to the platen. The assembly can be done without any additional expense in mounting steps or mounting tools. After the one-piece component has been mounted on the platen, the pressure key is pushed, quite simply along the platen and the desired break points are separated. After the functional components are separated from each other, each functional part is in its desired position, so that further mounting expense is no longer necessary.

According to a further development of the process of the invention, during the attaching of the one-piece mounting component on the platen, there takes place a solid (permanent) mounting of those of the functional parts which are intended to be arranged stationary on the platen. After this mounting, the pressure key is pushed farther and the desired break places are separated, with which a separation of the mounting components takes place.

Other advantageous details of the invention as well as a belt lock produced by the process of the invention are given from the example of execution represented in the drawing and described below.

FIGS. 3*a*, 3*b* to FIGS. 5*a*, 5*b* show the belt lock according to the preceding figures, in each case in top view and side section at three successive stages of the production process.

Figure 1:
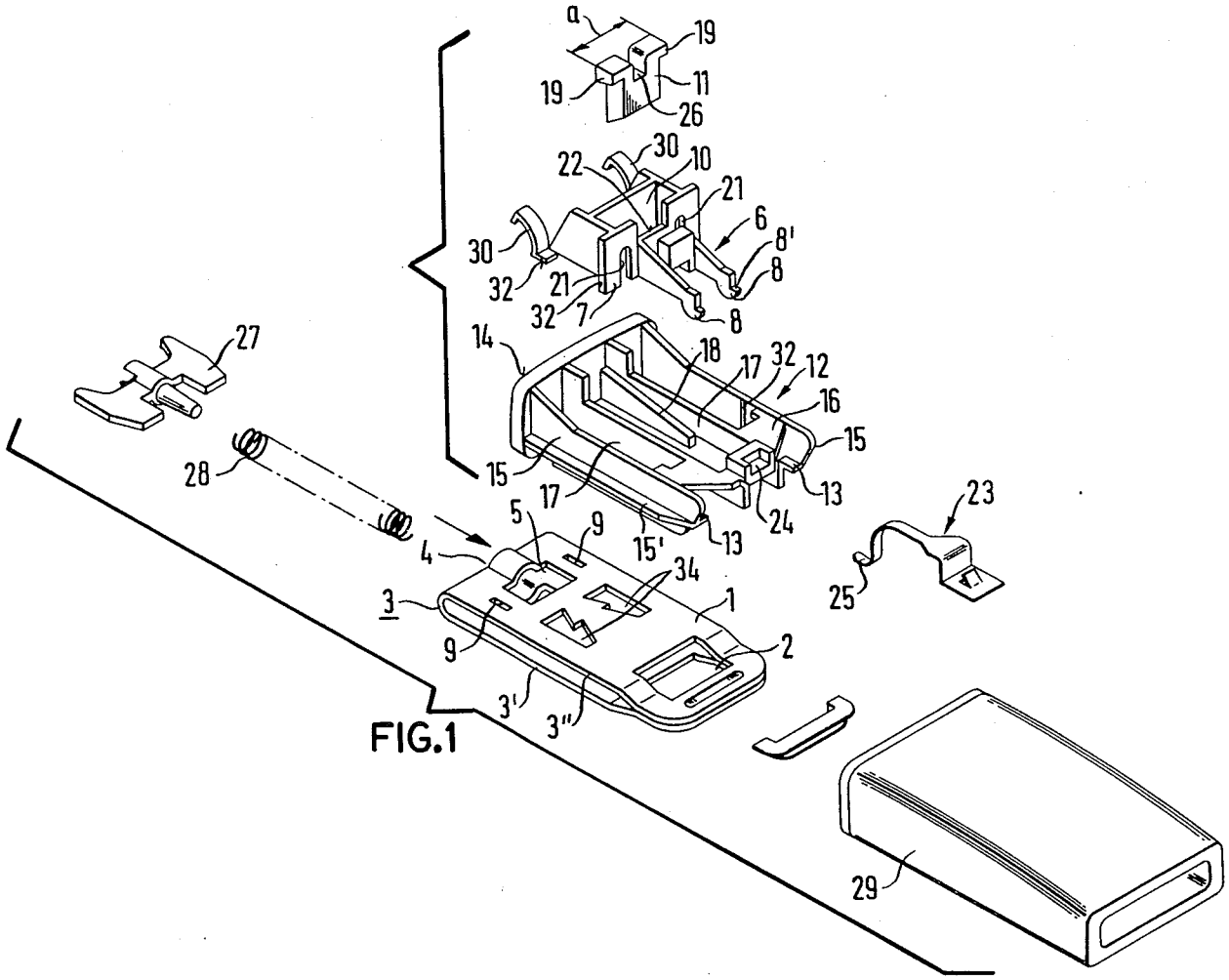
FIG. 1 is an exploded representation of the belt lock.
Figure 2:
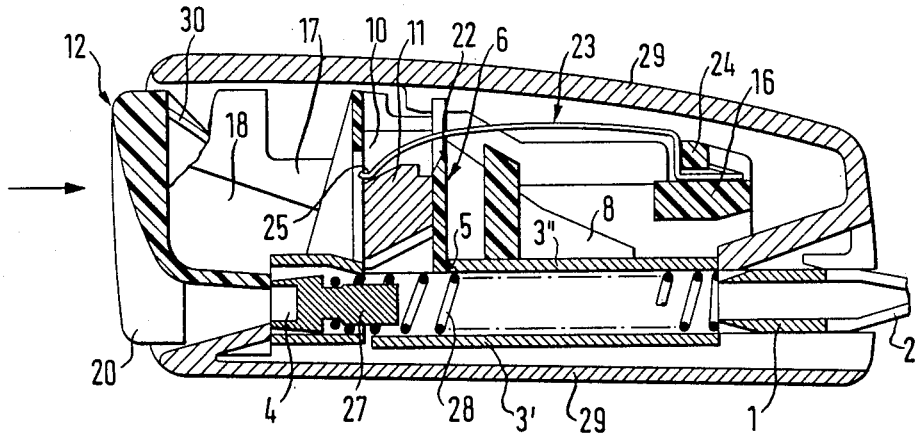
FIG. 2 shows a side section of the belt lock according to FIG. 1 in the unactuated rest position.

FIGS. 1 and 2 show clearly the construction of the belt lock. Here the stable base for the belt lock is a metal platen 1, bent in a U-shape, which at the open end has openings 2 for the fastening to a free end of the belt band or to a fitting, fastened to the floor of the vehicle, for example, these free ends of the platen are bent together and lie one on the other. On the non-free leg 3 of the platen, there is a receptacle opening 4 for a belt band insertion tongue, of design known per se and not further represented, for which the two platen part 3' and 3'', in connection with the insertion opening 4 form an insertion path. In the platen 1, bar or latch openings 5 are present for the insertion of a bar or latch, described below, transverse to the insertion path (arrow direction). A bar guide 6, designed as a plastic molded part which can be fastened to the platen part 3''; it can be fastened, for example, by means of added parts 7 and 8 into openings, for example, 9 and 34, of the platen part 3''. The bar guide 6 has a continuous guide channel 10, in which a metal bar 11 can be pushed along, transverse to the insertion path. Designated generally as 12 is a pressure key, also designed as a plastic injection molded part, which can be pushed parallel to the insertion path on the platen part 3'' and is supported on the bar guide 6. For this, the pressure key 12 has slide cheeks 13. The pressure key has a pressure surface 14. The pressure key is stabilized by the side cheeks 15 and by a connection stay 16, between these cheeks. Between the side cheeks 15 are guide cheeks 17, of which the distance apart corresponds approximately to a width a of the bar 11. On the inside of these guide cheeks 17 are stroke (lifting) surfaces 18, inclined diagonal, of which only one is shown in FIG. 1. By these stroke (lifting) surfaces 18, the bar 11 cooperates with addition-type noses (projections) 19, which have diagonal sliding surfaces which, with pushing of the pressure key in the arrow direction (FIG. 2), run up on the stroke to thereby move the latch member 11 to a disengaged condition surfaces 18, and slide on them for the carrying out of the bar stroke. The pressure key 12, which on the front side is provided with an insertion (plug-in) opening 20, slides by its guide cheeks 17 into the slot-like openings 21 of the bar guide 6. The bar guide has also a rigid, one-piece formed run-up (transition) edge 22, which cooperates, as will be described below, with an arc or sickle-type spring 23. This spring 23, with one free end, is fastened to a block-type bearing point 24 of the pressure key 12, for example, by welding with the plastic material. From this bearing point 24, the spring 23 extends in sickle form over the run-up edge 22, as shown particularly in FIG. 2, and is supported by the free end 25 against the bar 11, namely by a groove-like opening 26. This spring 23 presses the bar 11, with release of the pressure key 12, into the locking position, in which the bar 11 projects into the insertion path and locks the inserted plug tongue in the known way. FIG. 2 shows the position of the belt lock in which the plug tongue is not inserted, and in which the bar 11 is supported against an ejector (thrower-out) 27, movable along the insertion path, and is thus held in the open position. With insertion of the tongue, the ejector (27) is pressed back, against the force of the spring 28, along the insertion path, until the spring-weighted bar 11 is set free and falls into a corresponding opening into the insertion tongue, and locks the latter. If the insertion tongue is to be unlocked, the pressure key 12 is pushed in the arrow direction opposite the platen 1 and opposite the bar guide 6, together with the spring 23. Here, after a certain empty stroke, the strongly-curved free end of the spring 23 runs up on the transition edge 22 and is relieved of the bar 11, (not lifted at first), or slightly raised. FIG. 2 also shows that the parts explained are surrounded by a shell-type housing 29, which also forms a part of the insertion opening. As FIG. 1, in particular, shows, on both sides of the bar guide 6 are two springs 30, also sickle-type, formed in one piece, which are supported against the inside of the pressure surface 14 of the pressure key 12 and which provide for returning the pressure key to its original position after it is pressed in.

Figure 3A:
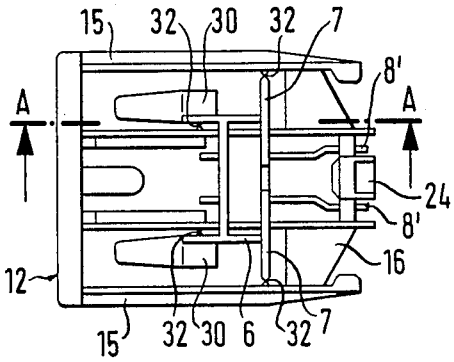
Figure 3B:
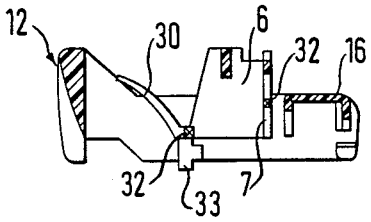

FIGS. 3*a* and 3*b* show the pressure key 12, as well as the bar guide 6, in top view and in section, schematically in each case. These two parts are made of plastic and are produced with the one-piece mounting component, in the injection molding process. Here, these two functional parts, 12 and 6 are connected in one piece through desired break points 32, that is, through joining places of very slight cross section. In the example of execution, the desired break points 32 are arranged between pressure key 12 and bar guide 6, in the zone of the added pieces 7 and at the base of the springs 30.

Figure 4A:
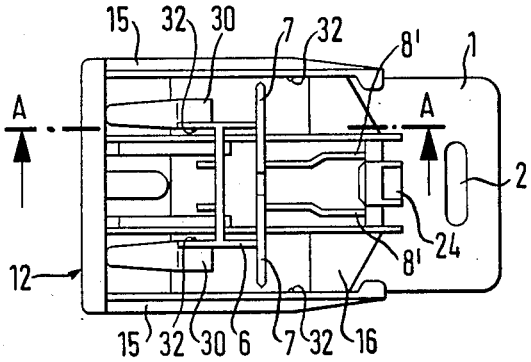
Figure 4B:
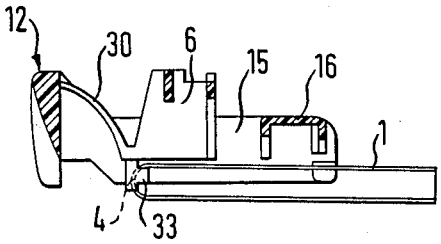

In FIGS. 4*a* and 4*b* is shown the mounting position in which the mounting component 6/12 is plugged or pushed into the platen 1. Serving here as a guide for the mounting component is the platen 1, with the side edges of which the cheeks 15 of the pressure key 12 are connected, for which purpose, on the insides of the side cheeks 15, guide additions 15' are arranged, which grip under the side edges of the upper platen part 3''. On this platen part 3'', therefore, is supported movable pressure key 15 and with it the whole mounting component, in the arrow direction according to FIG. 2. After the plugging (placing) of the mounting component on the platen 1, the hook-like fastening elements 8' and also the hook-like fastening elements 33 (FIGS. 2*b*, 4*b* and 5*b*) of the bar guide 6, lock into corresponding fastening openings or bearing openings 34 and into the insertion opening 4 of the platen 1. By pushing the pressure key 12 farther in the arrow direction, the desired break points 32 are separated and thus the pressure key 12 is loosened from the bar guide 6. For this separation, therefore, the pressure key 12 is pushed in the predetermined pushing direction.

Figure 5A:
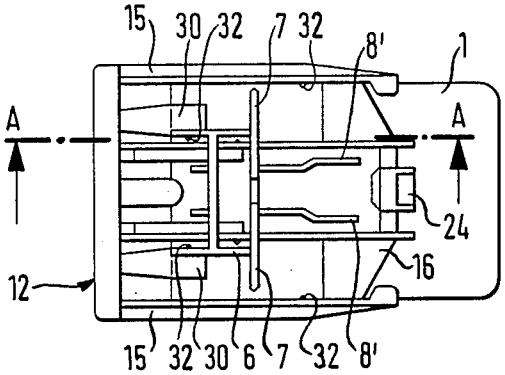
Figure 5B:
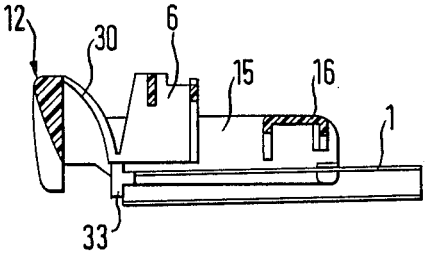

FIGS. 4*a* and 4*b* show clearly that after this pushing, the desired break points 32 of the two functional parts, at first joined with each other, lie at a distance from each other. In this position, the ends of the springs 30 are supported against the inner side of the pressure key 12, and press the pressure key 12 into the unactuated rest position. FIGS. 5*a* and 5*b* show this same arrangement, according to FIGS. 4*a* and 4*b*, but here, the pressure key 12 has been pushed, for the unlocking of the bar, movable in the bar guide 6, into the released operating position. The figures described above show only the parts necessary to an understanding of the invention. For this purpose, in all these figures, the platen 1 and the bar guide 6 are represented stationary, that is, in the position which remains the same, while the pressure key 12 is shown in different stroke positons. This is indicated by dot-and-dash lines. The figures shown also that, in the mounting, first the side cheeks 15 of the pressure key are pressed lightly apart, for setting onto the platen 1, after which the pressure key 12 and the mounting component, respectively, can be moved. The figures show also that the pressure key 12 is designed frame-like, and the bar guide 6 is within this frame. The frame is limited at the sides by the side cheeks 15 of the pressure key 12 by pushing the mounting component farther in the arrow direction, as explained, the bar guide is stopped automatically by the platen 1, after which the separation of the mounting component takes place.

I claim:

1. An apparatus for use in a safety belt buckle having a base plate and a latch member engagable with a tongue, said apparatus comprising latch guide means engagable with the base plate for guiding movement of the latch member relative to the base plate, actuator means for moving the latch member relative to the base plate from an engaged condition holding the tongue against movement relative to the base plate and a disengaged condition in which the latch member is ineffective to hold the tongue against movement, and frangible connection means for connecting said actuator means with said guide means to form a one-piece unit and for breaking upon the application of force to said actuator means to move said actuator means relative to said guide means.

2. An apparatus as set forth in claim 1 wherein said guide means includes first surface means for engaging the latch member to guide movement of the latch member relative to the base plate and second surface means for engaging the base plate to hold said guide means against movement relative to the base plate, said actuator means includes third surface means for engaging the latch member to move the latch member relative to said guide means upon movement of said actuator means relative to the base plate.

3. A method of making a safety belt buckle having a rigid base plate defining a belt tongue insertion path, belt tongue locking means having a first component fixed to the base plate and a second component movable relative to the first component to lock an inserted belt tongue in the buckle, and an actuator element disposed on the base plate and movable relative to the base plate to cause the second component to release the tongue, the method comprising the steps of forming the first component and the actuator element as a one-piece unit in which the first component and the actuator element are interconnected by frangible connections, mounting the one-piece unit on the base plate, and thereafter moving the actuator element relative to the base plate and first component to cause the frangible connections to break.

4. A method as claimed in claim 3, wherein the one-piece unit is an injection-moulded plastic unit.

5. A method as claimed in either claim 3 or claim 4, wherein the step of mounting the one-piece unit on the base plate includes connecting the first component to the base plate.

6. A method as claimed in claim 5, wherein the base plate is provided with openings and the step of mounting the one-piece unit on the base plate includes locating portions of the first component in the openings to secure the first component to the base plate.

7. A method of making a safety belt buckle having a base, a latch member movable relative to the base between an engaged condition and a disengaged condition, a guide section for guiding movement of the latch member, and an actuator member movable in a first direction relative to the base and guide section to move the latch member from the engaged condition to the disengaged condition, said method comprising the steps of providing a base, forming a guide section and actuator member as a one-piece unit separate from the base, mounting the one-piece unit on the base by connecting the guide section with the base, and, thereafter, disconnecting the actuator member from the guide section by applying force to the actuator member to break connections between the actuator member and guide section and move the actuator member in the first direction relative to the base and guide section.

* * * * *